US006213373B1

(12) United States Patent
Wakai

(10) Patent No.: US 6,213,373 B1
(45) Date of Patent: Apr. 10, 2001

(54) PLATE-SHAPED FASTENER AND DRIVING JIG FOR THE SAME

(75) Inventor: Takao Wakai, Higashiosaka (JP)

(73) Assignee: Wakai & Co., Ltd., Osaka (JP)

( * ) Notice: Subject to any disclaimer, the term of this patent is extended or adjusted under 35 U.S.C. 154(b) by 0 days.

(21) Appl. No.: 09/587,388

(22) Filed: Jun. 5, 2000

Related U.S. Application Data

(62) Division of application No. 09/386,455, filed on Aug. 31, 1999.

(30) Foreign Application Priority Data

Nov. 25, 1997 (JP) ..... 9-323068
Mar. 24, 1998 (JP) ..... 10-75783

(51) Int. Cl.[7] ..... B25C 1/02
(52) U.S. Cl. ..... 227/147; 227/119; 227/148
(58) Field of Search ..... 227/147, 148, 227/107, 119

(56) References Cited

U.S. PATENT DOCUMENTS 2,235,419 * 3/1941 Callahan et al. ..... 227/147
2,258,861 * 10/1941 Park et al. ..... 227/147
3,883,064 * 5/1975 Hilgers ..... 227/147
4,126,258 * 11/1978 Martin et al. ..... 227/148
4,263,903 * 4/1981 Griggs ..... 227/147
4,332,203 * 6/1982 Flowers ..... 227/147
4,805,824 * 2/1989 Erickson ..... 227/147

* cited by examiner

*Primary Examiner*—Scott A. Smith
(74) *Attorney, Agent, or Firm*—Wenderoth, Lind & Ponack, L.L.P.

(57) ABSTRACT

A plate-shaped fastener is driven obliquely into a wall member. When driving is complete, a member is superposed on the wall member, and a screw inserted through the member is threaded into the wall member. When the screw penetrates through the wall, it is threaded into the plate-shaped fastener. When the screw is tightened, the portion of the plate-shaped fastener protruding to the back of the wall is pulled against the back of the wall member, so that this portion of the plate-shaped fastener is bent and superposed on the back of the wall member. Thus, the member is securely fastened to the wall member with the wall member sandwiched between the member and the plate-shaped fastener. Also, a jig for driving the plate-shaped fastener is proposed which comprises a plate holder portion and a positioning plate portion.

2 Claims, 7 Drawing Sheets

PLATE-SHAPED FASTENER AND DRIVING JIG FOR THE SAME

This application is a divisional application of application Ser. No. 09/386,455, filed Aug. 31, 1999, pending.

BACKGROUND OF THE INVENTION

This invention relates to a plate-shaped fastener used to mount various instruments and members to interior walls and ceilings of plasterboard by means of screws.

This invention also relates to a driving jig used to obliquely drive the plate-shaped fastener to mount a member or an instrument to a plasterboard wall or a ceiling surface.

A conventional means for mounting various instruments and members to a wall or a ceiling constructed so as not to be accessible to its back, as shown in FIG. 8, includes a plug 4 having a plurality of bendable legs 2 integrally formed at the tip of a flanged sleeve 1, and provided with a nut member 3 at the tip of the group of bendable legs 2. In use, a hole 5 is drilled in a ceiling or wall A, the plug 4 is inserted into the hole 5, a screw inserted into the flanged sleeve 1 is threaded into the nut member 3 and tightened, the nut member 3 is pulled to bend the group of bendable legs 2 so that the plug 4 may not come off, the screw is pulled out, an instrument or member B is superposed on the ceiling or wall A, and a screw 6 is threaded through the instrument or member B into the nut member 3 to fasten the instrument or member B to the ceiling or wall A.

By the way, since such a plug 4 is prevented from coming off by bending the group of bendable legs 2 in the back of the ceiling or wall A, if the screw 6 is tightened strongly, co-turning tends to occur, so that no firm tightening force is obtainable, and also loosening tends to occur due to vibration. The resistance to pulling force is also weak. Moreover, since the plug is complicated in structure, the cost is high.

An object of this invention is to provide a plate-shaped fastener which is less likely to loosen by vibration, which provides tightening high in resistance to pulling force, and which is inexpensive in cost.

Another object of this invention is to provide a driving jig which makes it possible to drive in the plate-shaped fastener accurately at a predetermined angle, and with which the plate-shaped fastener can be held so as not to come off during driving, whereby the plate-shaped fastener can be driven in easily and moreover, the screw position can be clearly indicated when fastening by a screw.

SUMMARY OF THE INVENTION

According to this invention, there is provided a plate-shaped fastener having a fastener body formed from a metallic plate and formed with a hole adapted to threadedly engage a screw.

According to this invention, there is also provided a driving jig for a plate-shaped fastener used to drive the plate-shaped fastener having a hole for a screw, comprising a holder portion for movably containing the plate-shaped fastener in a guide path extending therethrough in a longitudinal direction, and a positioning plate portion integrally provided in a bent state at the tip of the holder portion and adapted to abut a driven surface of the plate-shaped fastener, the plate portion being provided with a tightening position indicating portion, a driving rod for driving the plate-shaped fastener inserted in the guide path of the holder portion, the holder portion being formed with an insertion hole for the driving rod, the holder portion being provided with resilient holding portions for the plate-shaped fastener inserted in the guide path, and a resilient holding portion for the driving rod inserted in the insertion hole.

Other features and objects of the present invention will become apparent from the following description made with reference to the accompanying drawings, in which:

DETAILED DESCRIPTION OF THE PREFERRED EMBODIMENTS

Figure 1A:
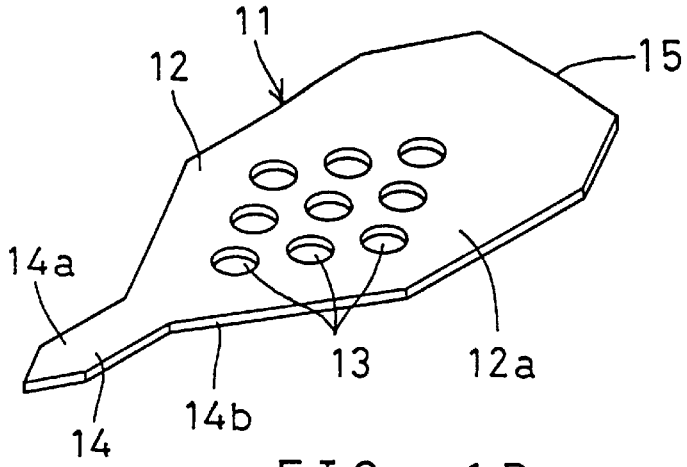
FIGS. 1A through 1C are perspective views showing different embodiments of plate-shaped fasteners.

Embodiments of this invention are described with reference to the drawings.

As shown in FIG. 1, the plate-shaped fastener 11 has a fastener body 12 formed from a metallic plate such as a stainless steel plate and having holes 13 into which a screw is adapted to be threaded. The fastener body 12 has a pointed end 14 at one end of a rectangular portion 12*a*, and a straight or convex striking edge 15 for driving at the other end. The holes 13 are formed in the central portion of this fastener body 12.

The plate-shaped fastener 11 of the first embodiment shown in FIG. 1A has its pointed end 14 formed by a forwardly protruding, narrow pointed portion 14*a*, and inclined edges 14*b* connecting with the portion 14*a* on both sides. The holes 13 formed in the central part of the rectangular portion 12*a* are a large number of independent holes.

Figure 1B:
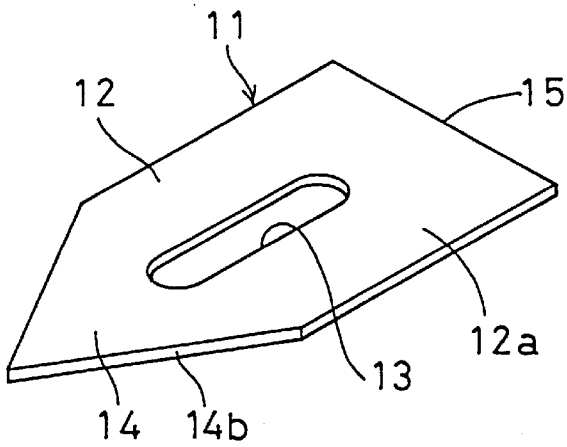

The plate-shaped fastener 11 of the second embodiment shown in FIG. 1B has its pointed end 14 with inclined edges 14*b* on both sides. The hole 13 is an elongate hole elongated in the direction in which the fastener body 12 is driven in.

Figure 1C:
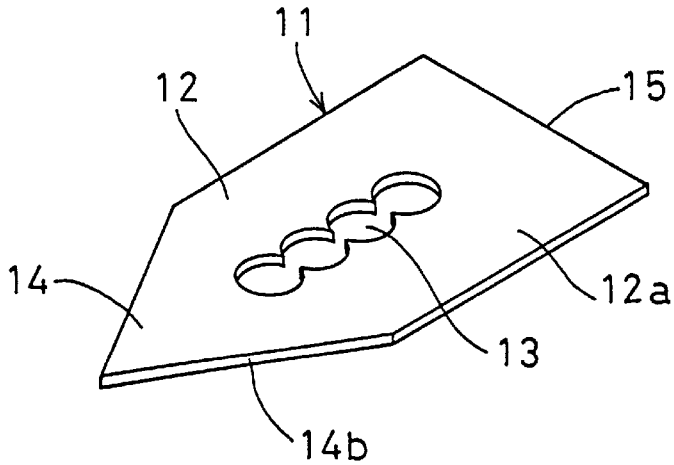

The plate-shaped fastener 11 of the third embodiment shown in FIG. 1C has its pointed end 14 with inclined edges 14*b* on both sides. The hole 13 is formed by arranging many circular holes along the driving direction of the fastener body 12 so as to overlap with each other.

Figure 2:
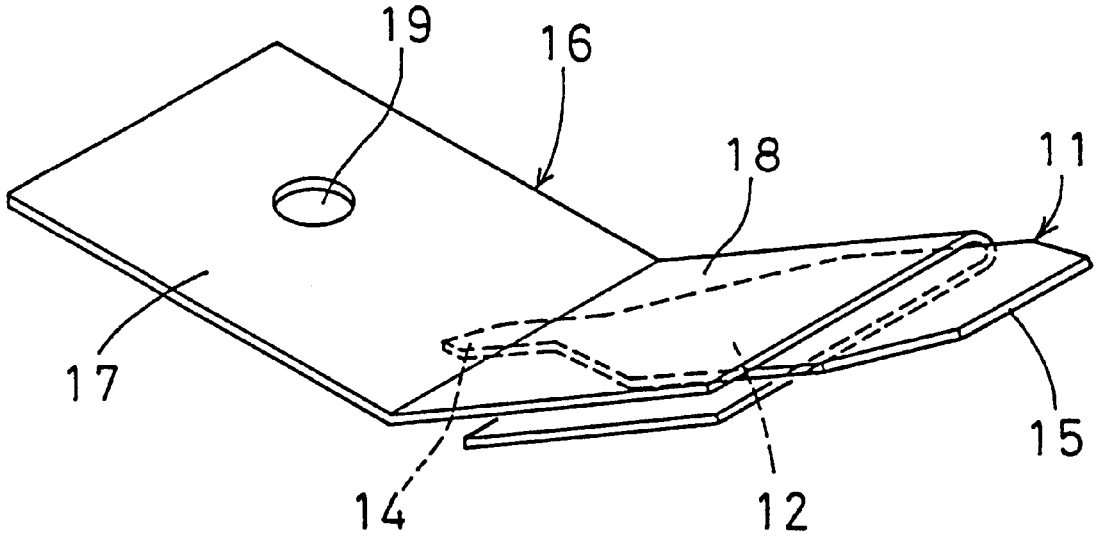
FIG. 2 is a perspective view of a guide gauge used to drive the plate-shaped fastener.

FIG. 2 is a guide gauge 16 used when the above plate-shaped fastener 11 is driven into a wall. A holder 18 for the plate-shaped fastener 11 is integrally formed at an angle at one end of a flat plate 17 which is to be superposed on the wall or ceiling. A hole 19 for alignment with the screw-threading position is formed in the flat plate 17. The holder 18 is formed by bending the flat plate 17 in half at its extended portion, and between its opposed surfaces, the plate-shaped fastener 11 is held in an inclined state with respect to the flat plate 17 so that it can be driven in.

The plate-shaped fastener of this invention has a structure as described above. We shall describe how to use it using FIGS. 3 and 4.

Figure 3:
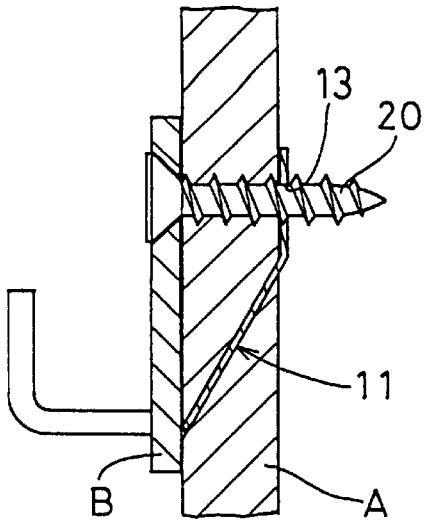
FIG. 3 is a sectional view showing how the plate-shaped fastener is used.

FIG. 3 shows how a member B is fastened to a wall member A using a single plate-shaped fastener 11. In this case, the plate-shaped fastener 11 has a relatively long rectangular portion 12*a*. By striking the striking edge 15 with a hammer from a point slightly spaced from the screw-tightening position, the plate-shaped fastener 11 is obliquely driven into the wall member A until the striking edge sinks below the surface of the wall member A and the pointed end 14 and the hole 13 protrude to the back of the wall member A.

When driving the plate-shaped fastener 11, using the guide gauge 16 shown in FIG. 2, the plate-shaped fastener 11 is set in the holder 18 with the flat plate 17 superposed on the surface of the wall member A and the hole 19 aligned with the screw tightening position. In this state, the plate-shaped fastener 11 is driven in, and the guide gauge 16 is removed when the tip of the plate-shaped fastener 11 has penetrated by some distance, and driving is continued. Thus, the positioning of the screw tightening position relative to the hole 13 can be done accurately.

When the driving of the plate-shaped fastener 11 ends, the member B is superposed on the wall member A. When a screw 20 inserted through the member B is threaded into the wall member A, the screw 20 penetrates through the wall member and is threaded into the hole 13 of the plate-shaped fastener 11. When the screw 20 is tightened, the portion of the plate-shaped fastener 11 protruding to the back of the wall member is pulled against the back of the wall member, so that this portion of the plate-shaped fastener 11 is bent and superposed on the back of the wall member. It is thus possible to fasten the member B to the wall member A with the wall member sandwiched between the member B and the plate-shaped fastener 11.

Figure 4:
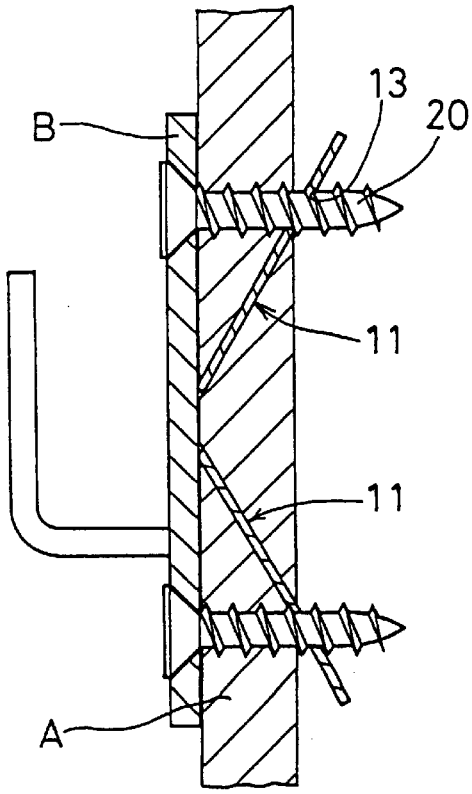
FIG. 4 is a sectional view showing another example in which the plate-shaped fasteners are used.

FIG. 4 shows an example in which the member B is fastened to the wall member A using a plurality of plate-shaped fasteners 11. In this case, each plate-shaped fastener has a relatively short rectangular portion 12*a*. Each plate-shaped fastener 11 is driven obliquely outwardly into the wall member A so that the hole 13 will be located right under the screw tightening position. When the screws 20 are threaded through the member B superposed on the surface of the wall member A into the wall member, the screws 20 penetrate through the member B and member A into the holes 13 of the plate-shaped fasteners 11. When the screws 20 are tightened, the member B are positioned, so that the plate-shaped fasteners 11 will become unmovable. A firmly tightened state is thus obtained.

In any of the examples, the driven portion of the plate-shaped fastener 11 is covered by the member B, so that a good finish is obtained. Since it is tightened by a screw 20 by driving in the plate-shaped fastener 11, it is possible to obtain such a strong resistance to pulling force as to destroy the wall member A.

According to this invention, the plate-shaped fastener is formed with a hole for threading a screw. By driving it obliquely so that the hole is located right under the screw tightening position and by threading a screw, it is possible to easily fasten various members to a plasterboard. Since the plate-shaped fastener is formed from a metallic plate, the cost is low. Once driven in, it absorbs vibrations from outside and is effectively prevented from loosening after being tightened.

Also, since the plate-shaped fastener is driven in obliquely and fastened by a screw at the back of the plasterboard, tightening with high resistance to pulling force is assured.

By the way, since the plate-shaped fastener has to be driven obliquely into a plasterboard wall or ceiling surface while holding it by hand, not only is driving difficult, but also, it will come off easily if holding is insufficient. Driving into a ceiling surface is especially difficult.

Also, with the plate-shaped fastener, due to its structure, the portion with the screw hole is disposed in the back of a plasterboard wall or ceiling surface after driving, so that it is difficult to know the screw position when the member or instrument is fastened by a screw.

Figure 5A:
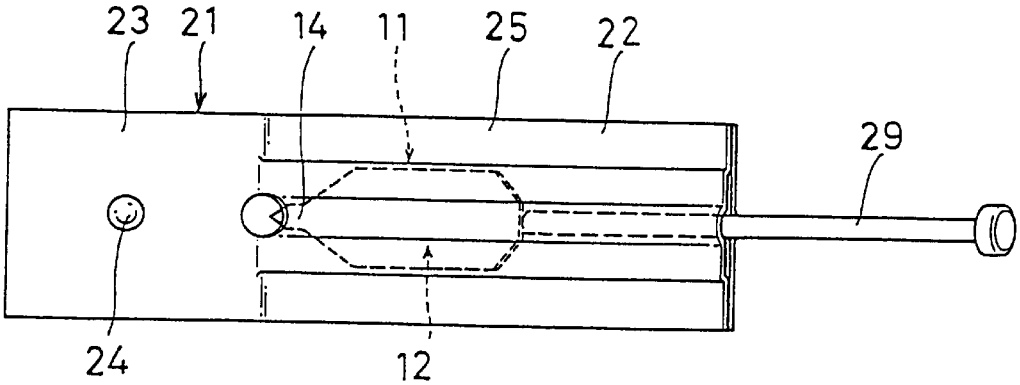
FIG. 5A is a plan view of the driving jig according to the present invention.
Figure 5B:
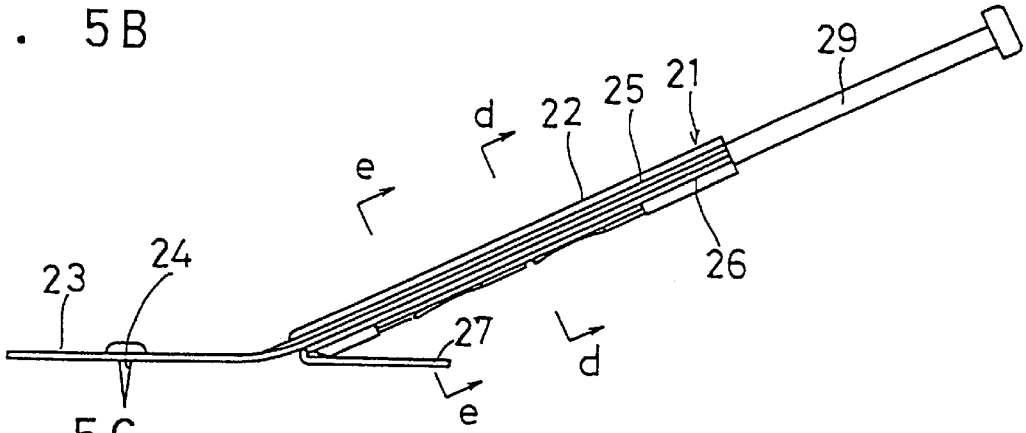
FIG. 5B is its front view.
Figure 5C:
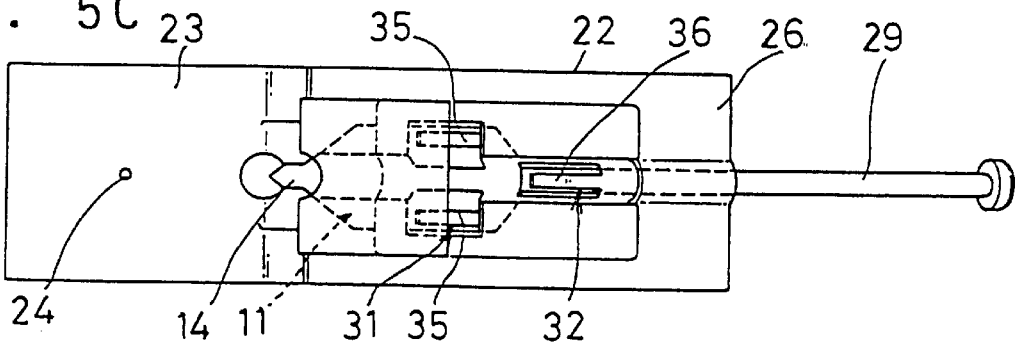
FIG. 5C is its bottom view.
Figure 5D:
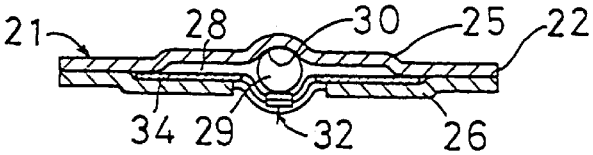
FIG. 5D is a sectional view along arrow d—d of FIG. 5B.
Figure 5E:
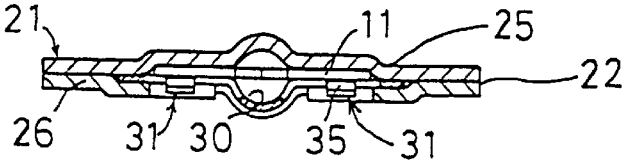
FIG. 5E is a sectional view along arrow e—e of FIG. 5B.
Figure 6:
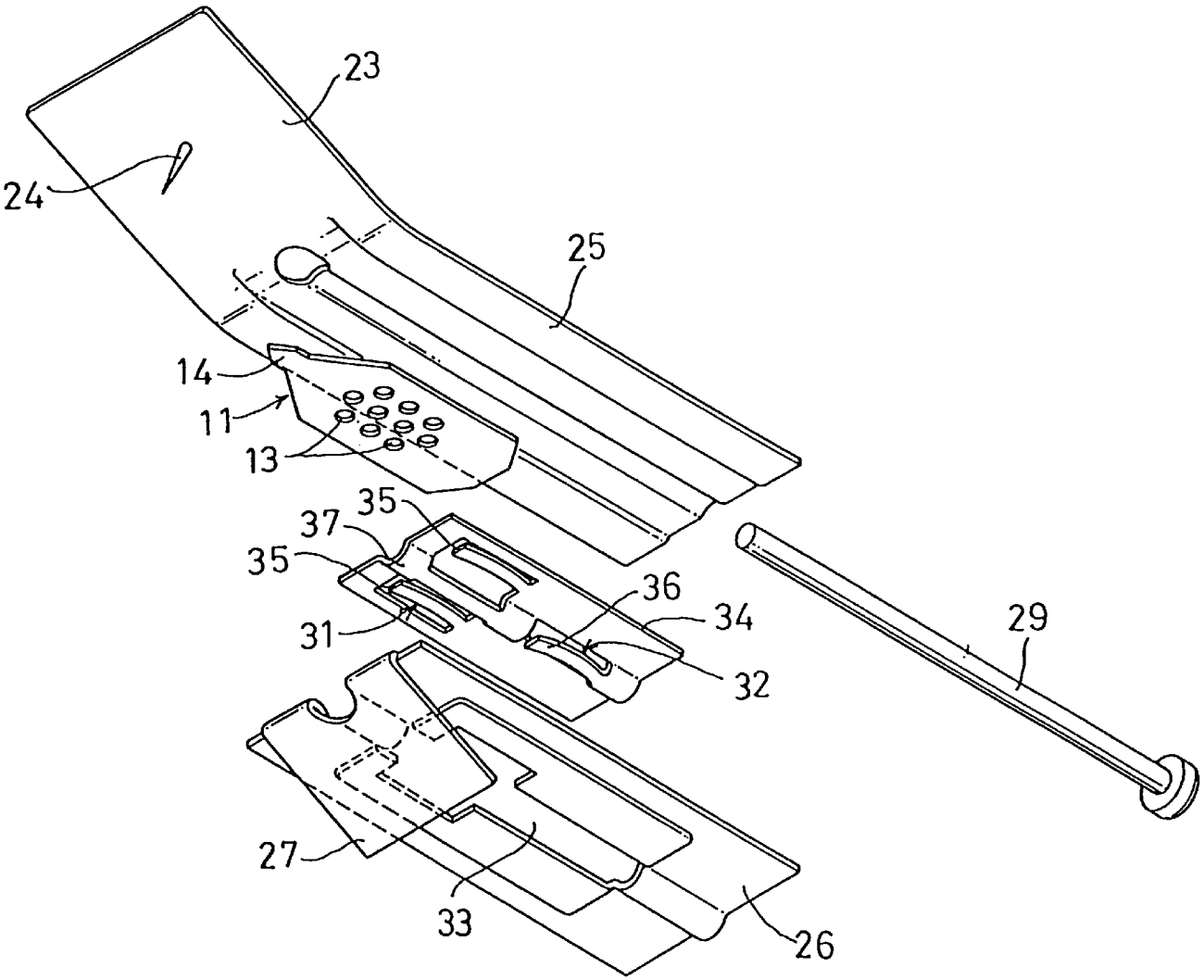
FIG. 6 is an exploded perspective view of the driving jig.

FIGS. 5 and 6 show a driving jig according to the present invention used to drive this plate-shaped fastener into a plasterboard wall or a ceiling surface.

The driving jig 21 includes a holder portion 22 for movably containing the plate-shaped fastener, and a positioning plate portion 23 integrally provided in a bent state at the tip of the holder portion 22 and adapted to abut the surface into which the plate-shaped fastener 11 is driven. A tightening position indicating portion 24 is provided on this plate portion 23.

The holder portion 22 has a top plate 25 in the form of an elongated metallic plate, and a substantially identically shaped bottom plate 26 superposed on the top plate and fixed thereto by welding or riveting. The plate portion 23 is formed integrally at the tip of the top plate 25 so as to be bent at a predetermined angle. An auxiliary plate portion 27 is integrally formed at the tip of the bottom plate 26 so as to be bent toward the opposite direction at a predetermined angle so that the plate portion 23 and the auxiliary plate portion 27 are in a common plane.

Between the top plate 25 and the bottom plate 26, a guide path 28 in which the plate-shaped fastener 11 is receivable is formed to extend therethrough in the longitudinal direction. At the widthwise center of this guide path 28, an insertion path 30 for a driving rod 29 for driving the plate-shaped fastener 11 inserted into the guide path 28 is formed so as to extend therethrough in the longitudinal direction. This insertion path 30 is formed cylindrically by bending the top plate 25 and the bottom plate 26 outwardly opposite to each other at a position corresponding to the central portion of the guide path 28.

The abovementioned driving rod 29 is used to drive forwardly the plate-shaped fastener 11 inserted in the guide path 28. Its length is substantially equal to or longer than the holder portion 22.

The holder portion 22 is provided with resilient holding portions 31 for the plate-shaped fastener 11 inserted in the guide path 28, and a resilient holding portion 32 for the driving rod 29 inserted in the insertion path 30. By these resilient holding portions 31, 32, the plate-shaped fastener 11 and the driving rod 29 inserted in the holder portion 22 are held so as not to fall out even if the holder portion 22 stands vertically.

These resilient holding portions 31, 32 are formed by inserting a resilient metallic plate 34 between the top and bottom plates 25 and 26 at a portion corresponding to a window hole 33 formed in the bottom plate 26, and providing the resilient metallic plate 34 with spring pieces 35 which serve as the resilient holding portions 31, on both sides facing the guide path 28, and a spring piece 36 which serves as the resilient holding portion 32, at a position facing the insertion path 30.

The resilient metallic plate 34 has a semicircular portion 37 which covers the missing portion of the insertion path 30 due to the formation of the window hole 33.

The tightening position indicating portion 24 provided on the plate portion 23 is formed by a pointed pin which is driven into the surface of the wall A (FIG. 7), and is arranged to correspond to the hole 13 for a screw for tightening the plate-shaped fastener 11. This indicating portion 24 serves to fix the driving jig 21 to the wall surface, but may simply be a round hole.

The driving jig 21 of this invention is structured as described above. In order to fasten a member or instrument B to a plasterboard wall A or a ceiling surface using the plate-shaped fastener 11 and the screw, first, the plate-shaped fastener 11 is inserted into the guide path 28 of the holder portion 22. The driving rod 29 is then inserted into the insertion path 30, and the plate-shaped fastener 11 is pushed forward by driving the driving rod 29 until the tip of the plate-shaped fastener 11 arrives at the tip of the holder portion 22 (FIG. 5A).

In this state, the plate-shaped fastener 11 is urged and held by the resilient holding portion 31, and the driving rod 29 is held by the resilient holding portion 32, so that they will not drop irrespective of the position of the driving jig 21.

Figure 7:
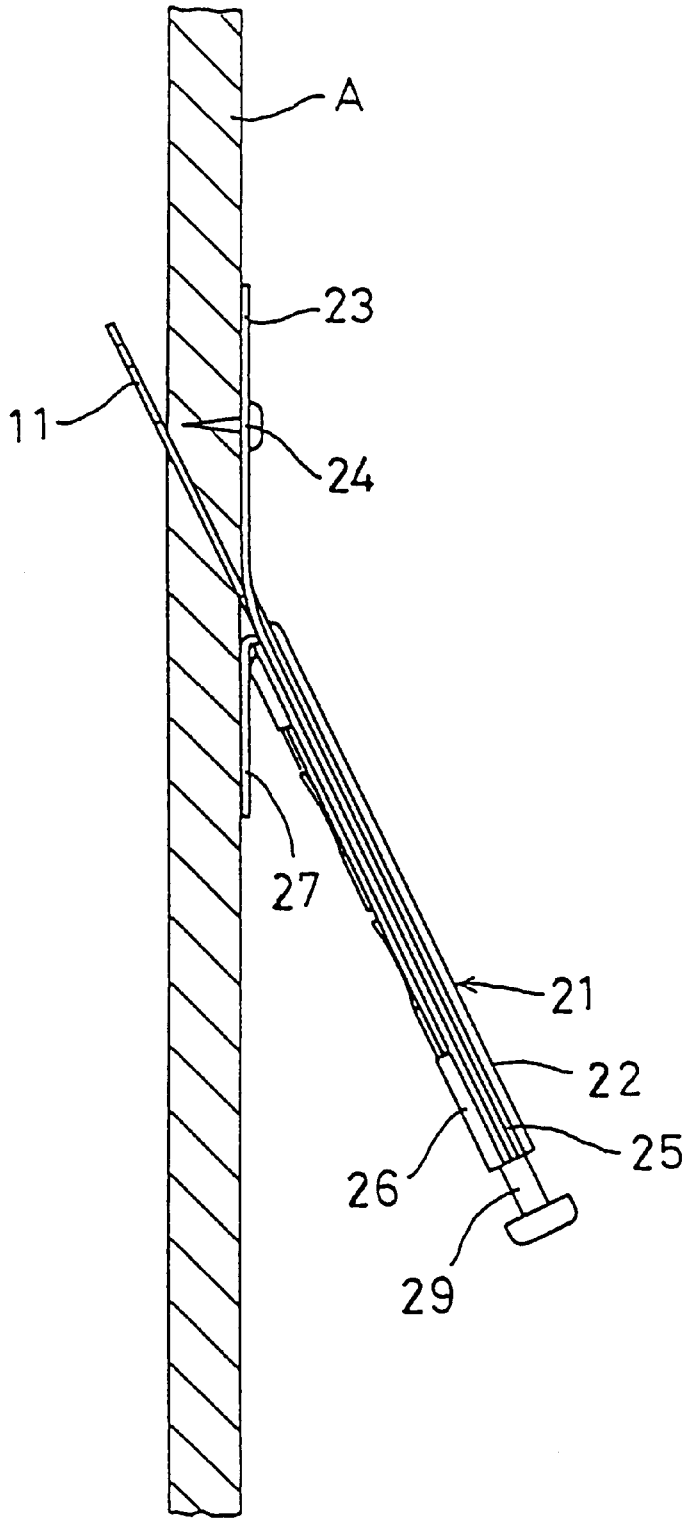
FIG. 7 is a sectional view showing a driven state of a plate-shaped fastener using the driving jig.
Figure 8:
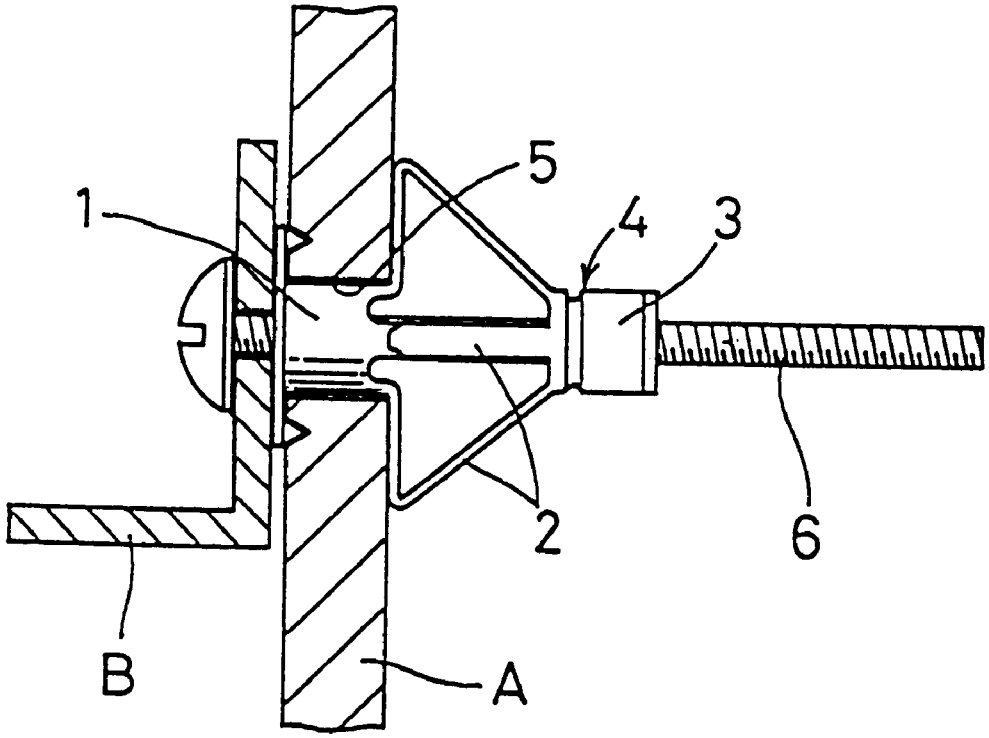
FIG. 8 PRIOR ART
FIG. 8 is a sectional view showing a conventional fastener.

Holding by hand the driving jig 21 in which are set the plate-shaped fastener 11 and the driving rod 29, as shown in FIG. 7, the plate portion 23 is superposed on the plasterboard wall A or ceiling surface to which a member or an instrument is to be fixed, the indicating portion 24 is driven in at the screw tightening position.

Now the driving jig 21 is positioned with respect to the plasterboard wall A or ceiling surface, so that due to the angle between the holder portion 22 and the plate portion 23, the plate-shaped fastener 11 held by the holder portion 22 is positioned at a predetermined angle relative to the plasterboard wall A or ceiling surface. When the driving rod 29 is driven in by striking it with a hammer in this state, the plate-shaped fastener 11 to which the tip of the driving rod 29 is abutting is pushed forward while being guided by the holder portion 22, and driven into the plasterboard wall A or ceiling surface at its pointed end 14 at an angle.

When the tip of the driving rod 29 reaches the plasterboard wall A or ceiling surface and the plate-shaped fastener 11 is completely driven in, the latter has penetrated through the plasterboard wall A or ceiling surface in an inclined state, so that the pointed end 14 protrudes a predetermined length from the plasterboard wall A or ceiling surface. This completes the driving step of the plate-shaped fastener 11. By pulling out the indicating portion 24, the driving jig 21 can be removed from the wall A or ceiling surface.

A member or an instrument is superposed on the plasterboard wall A or ceiling surface so that its screw hole aligns with a hole from which the indicating portion 24 has been removed. A screw inserted into the screw hole is threaded into the plasterboard wall A or ceiling surface. When the tip of the screw which penetrated through the plasterboard wall A or ceiling surface is inserted into the thread-engagement hole 13 of the plate-shaped fastener 11 at the back of the plasterboard wall A or ceiling surface, the portion of the plate-shaped fastener 11 protruding to the back of the plasterboard wall A or ceiling surface will be bent and superposed onto the back of the plasterboard wall A or ceiling surface. Thus, with the plasterboard wall A or ceiling surface sandwiched between the member or instrument and the bent portion of the plate-shaped fastener 11, the member or instrument is fastened to the plasterboard wall A or ceiling surface by tightening the screw.

Since the plate-shaped fastener 11 is guided by the holder portion 22 of the driving jig 21, driving can be done accurately at a desired inclination angle with respect to the plasterboard wall or ceiling surface. Also, since the plate-shaped fastener 11 and the driving rod 29 are held resiliently in a set state in the driving jig 21, they will not come off irrespective of its position. In particular, a member or an instrument can be fixed to a ceiling surface without difficulty.

According to this invention, since the insertion path for the driving rod is formed in the holder portion, and the resilient holding portion for the plate-shaped fastener and that for the driving rod are formed, it is possible to drive the plate-shaped fastener accurately into a plasterboard wall or ceiling surface at a required angle.

Also, since the screw threading position can be found accurately due to the screw position indicating portion on the plate portion, by making this indicating portion in the form of a pointed pin, the driving jig can be easily positioned, so that the plate-shaped fastener can be driven in stably.

What is claimed is:

1. A driving jig for a plate-shaped fastener used to drive the plate-shaped fastener having a hole for a screw, comprising a holder portion for movably containing the plate-shaped fastener in a guide path extending therethrough in a longitudinal direction, and a positioning plate portion integrally provided in a bent state at the tip of said holder portion and adapted to abut a driven surface of the plate-shaped fastener, said plate portion being provided with a tightening position indicating portion, a driving rod for driving the plate-shaped fastener inserted in said guide path of said holder portion, said holder portion being formed with an insertion hole for said driving rod, said holder portion being provided with resilient holding portions for the plate-shaped fastener inserted in said guide path, and a resilient holding portion for said driving rod inserted in the insertion hole.

2. The driving jig claimed in claim 1 wherein said tightening position indicating portion provided on said plate portion is a pin with a pointed tip which is to be driven into a surface into which the plate-shaped fastener is to be driven in.

* * * * *